United States Patent [19]

Toda et al.

[11] 4,237,837

[45] Dec. 9, 1980

[54] EXHAUST GAS RECIRCULATION FOR A DIESEL ENGINE

[75] Inventors: Tadahide Toda, Mishima; Tatehito Ueda, Susono, both of Japan

[73] Assignee: Toyota Jidosha Kogyo Kabushiki Kaisha, Toyota, Japan

[21] Appl. No.: 898

[22] Filed: Jan. 4, 1979

[30] Foreign Application Priority Data

Sep. 13, 1978 [JP] Japan ..... 53-111736

[51] Int. Cl.[3] ..... F02M 25/06

[52] U.S. Cl. ..... 123/569

[58] Field of Search ..... 123/119 A

[56] References Cited

U.S. PATENT DOCUMENTS

| | | | |
|---|---|---|---|
| 3,741,179 | 6/1973 | Vartanian | 123/119 A |
| 3,766,896 | 10/1973 | Buehler et al. | 123/119 A |
| 4,100,734 | 7/1978 | Ozaki et al. | 123/119 A |
| 4,171,689 | 10/1979 | Eheim | 123/119 A |

FOREIGN PATENT DOCUMENTS

| | | | |
|---|---|---|---|
| 2232705 | 1/1974 | Fed. Rep. of Germany | 123/119 A |
| 2303007 | 7/1974 | Fed. Rep. of Germany | 123/119 A |
| 2829621 | 1/1979 | Fed. Rep. of Germany | 123/119 A |

*Primary Examiner*—Wendell E. Burns

*Attorney, Agent, or Firm*—Kenyon & Kenyon

[57] ABSTRACT

An exhaust gas recirculation control valve for a diesel engine. The valve comprises a valve casing of a rectangular cross-sectional shape disposed in the intake line of the engine. A valve seat connected to an exhaust line of the engine via an EGR passageway is formed in a side wall of the rectangular-shaped valve casing. A valve member is arranged in the casing and then rotated about an axis located upstream of the valve seat in such a manner that the valve member is moved between a position wherein valve member closes the valve seat and another position wherein the plate closes the intake passageway. The valve member comprises a base portion of a flat shape and a guide portion which is inserted into the valve seat when the degree of opening of the valve member is small.

6 Claims, 7 Drawing Figures

EXHAUST GAS RECIRCULATION FOR A DIESEL ENGINE

FIELD OF THE INVENTION

The present invention relates to an exhaust gas recirculation for a diesel type internal combustion engine.

In a diesel engine an excess amount of air is always introduced into the combustion chamber of the engine. Therefore, an exhaust gas recirculation operation for a diesel engine is advantageously controlled relative to this excess. Since the amount of excess air decreases in accordance with the increase of the load of the engine, required is a type of valve device for controlling the amount of fluid directed to the engine in such a way that the amount of recirculated exhaust gas introduced into the engine intake passageway is decreased while the amount of intake air directed to the engine is increased in accordance with an increasing engine load. In order to effectively control the exhaust gas recirculation, a linear relationship should be obtained between the opening of the control valve which corresponds to the load of the engine and the ratio of the amount of recirculated exhaust gas to the total amount of fluid directed to the engine (the so-called EGR ratio).

SUMMARY OF THE INVENTION

An object of the present invention is to provide a valve unit which is advantageously utilized in an exhaust gas recirculation system for a diesel engine.

Another object of the present invention is to provide a valve unit which can maintain a substantially linear relationship between the degree of opening of the valve unit and the value of the EGR ratio.

According to the present invention a valve device adapted to be used for an exhaust gas recirculation system for a diesel engine is provided. The valve device comprises a tubular casing defining a passageway of a substantially rectangular cross-sectional shape, through which intake air into the engine passes, such casing having, on one side wall thereof, an exhaust gas inlet opening adapted to be connected to the exhaust gas recirculation system; a valve shaft rotatably mounted, at a position located upstream of the opening, to the casing so that the shaft is substantially in contact with the inner surface of the side wall while being located transverse to the flow of intake air; and a valve member comprising a base portion comprising a substantially rectangular plate, one end of the plate being fixedly secured to the valve shaft, and a guide portion which is located on one side of the base portion facing the opening, the guide portion being inserted into the inlet opening when the degree of opening of the valve member is small. Thus, a substantially linear relationship is obtained between the EGR ratio and the degree of opening of the valve member opening.

BRIEF DESCRIPTION OF ATTACHED DRAWINGS

DETAILED EXPLANATION OF PREFERRED EMBODIMENTS

Figure 1:
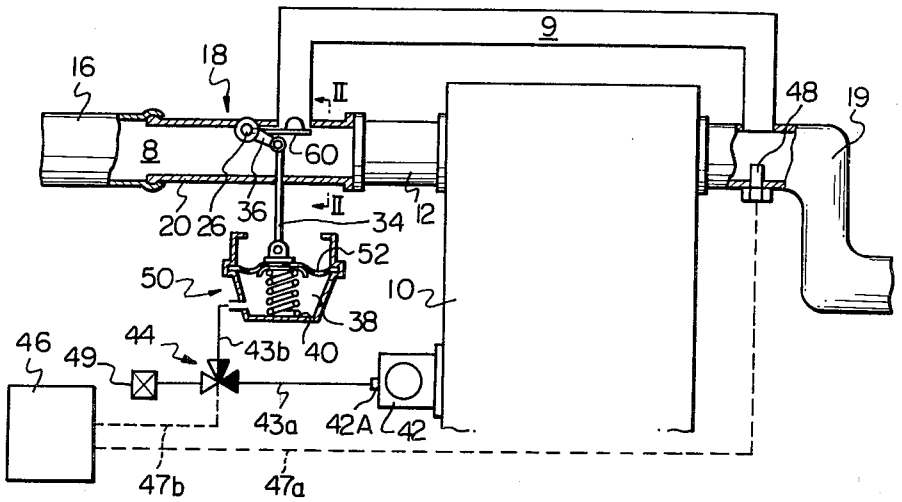
FIG. 1 is a schematic view of an exhaust gas reicrculation system according to the present invention.

Referring to FIG. 1, a diesel engine includes an engine body 10 having combustion chambers therein with which an intake manifold 12 communicates. An intake pipe 16 is connected, on its upstream end, to a not shown air cleaner to receive air therefrom. The air is introduced, via an exhaust gas recirculation control valve device 18 of the present invention, which will be fully described later, into the intake manifold 12. An exhaust manifold 19 communicates with the combustion chambers for receiving exhaust gas therefrom.

The control valve device 18 includes a casing 20 which is, on one end thereof, connected to the pipe 16 and is, on the other end thereof, connected to the intake manifold 12. In the casing 20, between the intake pipe 16 and the intake manifold 12, an intake passageway 8 is formed. The valve casing 20 is connected to the exhaust manifold 19 by way of an exhaust gas recirculation passageway 9. The valve device 18 serves to control the amount of the exhaust gas introduced into the intake passageway 8 from the EGR passageway 9. The valve device 18 is provided with a valve element 24 having a plate-like shape which is arranged in the valve casing 20. The valve plate 24 is connected, in a cantilever fashion, to a valve shaft 26 which is rotatably mounted to the casing 20 so that the shaft 26 is located upstream of the end of the EGR passageway 9 which is opened to the intake passageway 8. Therefore, the ratio of the amount of recirculated exhaust gas introduced into the intake passageway 8 to the amount of total fluid introduced into the engine (the so-called EGR ratio) is controlled by turning the valve plate 24 about an axis of the shaft 26.

Figure 2:
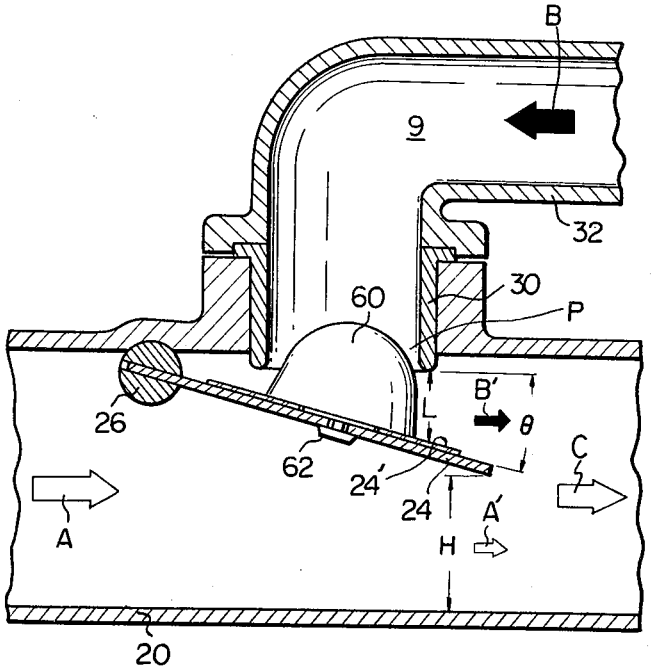
FIG. 2 is an enlarged sectional view of a valve device utilized in the system of FIG. 1.
Figure 2A:
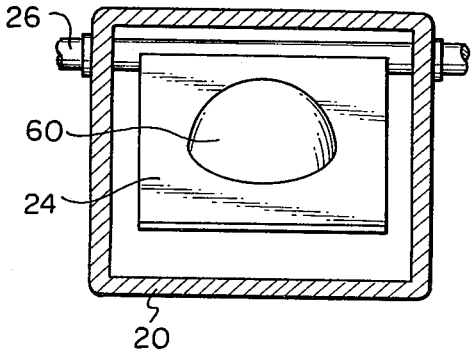
FIG. 2A is a cross-sectional view taken along the II—II line shown in FIG. 1.

As shown in FIG. 2, which is a partially enlarged view of FIG. 1, the casing 20 of the EGR control valve 18 (FIG. 1) is a tubular member of a rectangular cross-sectional shape, in which the valve plate 24 of a substantially rectangular shape is arranged (sea FIG. 2A). One end of the valve plate 24 is fixedly mounted to the valve shaft 26 which extends transverse to the flow of intake air in the intake passageway 8. The shaft or rod 26 is rotatably mounted to opposite side walls of the rectangular casing 20 in such a manner that the valve rod 26 substantially contacts the inner surface of an upper wall of the casing 20 adjacent the opposite side walls. To the upper side of the valve casing 20 a valve seat 30 of an annular shape is fixedly inserted. A pipe 32 is, on one end thereof connected to the annular valve seat 30. The other end of the pipe 32 is connected to the exhaust manifold 19 (FIG. 1) by any suitable means which is well known to those skilled in this art. The valve seat 30 and the pipe 32 form therein the EGR passageway 9 shown in FIG. 1.

As shown in FIG. 2, the valve plate 24 has, on one side thereof facing the valve seat 30, a layer 24' of a seal member made of a rubber material. Therefore, the valve plate 24 is sealingly positioned on the valve seat 30, when the valve 18 is in its closed position where the EGR passageway 9 is disconnected from the intake passageway 8 for stopping the EGR operation.

The EGR system shown in FIG. 1 is further provided with a mechanism for controlling the amount of the recirculated exhaust gas in accordance with the load of the engine. The mechanism comprises a vacuum actuator 50 having a diaphragm 52 which is connected to, via a rod 34, one end of a lever 36. The other end of the lever 36 is fixedly mounted to an end of the valve shaft 26 projecting out of the casing 20. On one side of the diaphragm 52 remote from the rod 34, a vacuum chamber 38 is formed, in which chamber 38 a spring 40 is arranged for urging the diaphragm 52 so that the valve plate 24 is turned in a counterclockwise direction. The mechanism is further provided with a vacuum signal generator for generating a vacuum signal to be transmitted into the chamber 38 of the actuator 50. The generator comprises a vacuum pump 42 operated by a not shown crankshaft of the engine. The output port 42A of the pump 42 is connected, via a vacuum line 43*a*, a vacuum switching valve 44 and another vacuum line 43*b*, to the vacuum chamber 38 of the actuator 50. The vacuum switching valve 44 is an electro-magnetic valve operated by an electrical circuit 46 which receives an electrical signal transmitted, via an electrical line 47*a*, from a sensor 48 arranged in the exhaust manifold 19 for detecting the concentration of oxygen of the exhaust gas. Since the concentration of oxygen of the exhaust gas in the diesel engine corresponds to the load of the engine, the sensor 48 issues an electrical signal indicating the load of the engine to the circuit 46. This circuit 46 provides an electrical signal, which is transmitted to the switching valve 44 via another electrical line 47*b*, for selectively connecting the chamber 38 of the actuator 50 with the vacuum pump 42 or an atmospheric air pressure source 49, so that the vacuum level in the chamber 38 is controlled in accordance with the load of the engine. Thus, the EGR ratio is controlled by the vacuum actuator 50 in accordance with the load of the engine as will be fully described later.

When the valve shaft 26 is turned about the axis thereof in a clockwise direction in the drawing by a vacuum force generated in the diaphragm 52 of the vacuum actuator 50, the valve plate 24 is detached from the valve seat 30 as shown by FIG. 2. Intake air introduced into the valve casing 20 as shown by an arrow A passes through under the valve plate 24 as shown by an arrow A'. Exhaust gas introduced into the coupling pipe 32 as shown by an arrow B passes through over the valve plate 24 as shown by an arrow B'. The flow of intake air as shown by the arrow A' and the flow of the exhaust gas as shown by the arrow B' are mixed together and then directed to the engine as shown by an arrow C. The more the valve shaft is turned in the clockwise direction of FIG. 2 for increasing the amount of exhaust gas introduced into the casing 20, as shown by the arrow B', the smaller the amount of the intake air, as shown by the arrow A'. Therefore, the EGR ratio, which is the ratio of the amount of the exhaust gas flow as shown by the arrow B' to the amount of the mixed flow as shown by the arrow C, is controlled in accordance with the degree of the opening of the valve plate 24.

The amount of intake air passing through under the valve plate 24 as shown by the arrow A' corresponds to a minimum or effective flow area H located between the valve plate 24 and the inner surface of the casing 20. The amount of exhaust gas passing through over the valve plate 24 as shown by the arrow B' corresponds to a minimum or effective flow area L located between the valve plate 24 and the valve seat 30. Thus, the EGR ratio is obtained by calculating the ratio of L, to H+L with respect to every degree of the opening $\theta$ of the valve plate.

Figure 3:
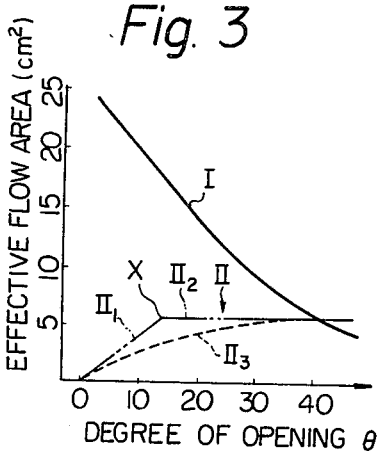
FIG. 3 is a graph showing the relationships between the opening of the valve device and the effective flow area.

The effective flow area H varies in accordance with the degree $\theta$ of the opening of the valve plate 24 as shown by the curve I in FIG. 3. As is clear from curve I, the effective flow area H is inversely proportional to the degree of the opening $\theta$ of the valve plate 24.

Figure 4:
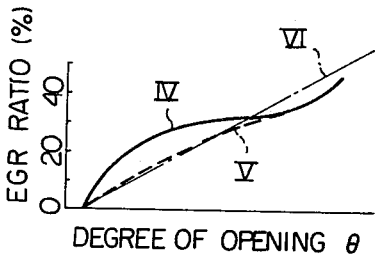
FIG. 4 is a graph showing the relationships between the opening of the valve plate and the EGR ratio.

Now, assume that the valve plate 24 forms a flat plane. As shown by the segment $II_1$, the effective flow area L is proportional to the degree of the opening when the opening $\theta$ is less than x degree. When the degree of the opening $\theta$ is larger than "x", the effective flow area L is maintained at a predetermined constant value "y", which value corresponds to a minimum inner diameter of the EGR passageway 9. Thus, the EGR ratio, which is obtained from II/(I+II), is shown by the curve IV in FIG. 4, which does not coincide with the ideal straight curve VI when the degree of the opening $\theta$ is small. The reason for this noncoincidence resides in the fact that the rate of increase the flow area L of the exhaust gas is too high when the valve plate 24 is opened from its fully closed position. Accordingly, the non-linear relationship existing between the EGR ratio and the degree of opening $\theta$ of the valve plate 24 makes it impossible to precisely control the EGR operation of the diesel engine.

According to the present invention, a means is provided for obtaining a linear relationship between the EGR ratio and the degree of the opening of the valve plate 24. As shown in FIG. 2, a guide member 60 of a circular cross-section is fixedly mounted by means of a screw 62 to one side of the valve plate 24 facing the valve seat 30. The guide member 60 is located on the valve plate 24 at the center thereof. The guide member 60 defines a tapering surface which converges upwardly. The guide member 60 has an upper portion which is located in the valve seat 30 when the degree of the opening $\theta$ of the valve plate is small.

According to the present invention, the recirculated exhaust gas passes through a restricted area P formed between the valve seat 30 and the guide member 60. Thus, the rate of increase in the flow area of the exhaust gas, when the valve plate is opened from its fully closed position, is low as shown by the curve $II_3$ in FIG. 3. As a result of this, the EGR ratio, which is obtained by $II_3/(I+II_3)$, can substantially conform to the ideal linear relationship shown by the curve VI, when the opening is small. Due to the linear relationship obtained between the EGR ratio and the degree of the opening $\theta$ of the valve plate, the vacuum actuator 50 can effectively control the EGR ratio in accordance with the load of the engine for carrying out an ideal EGR operation for decreasing the amount of $NO_x$ emission from the diesel engine.

Figure 5:
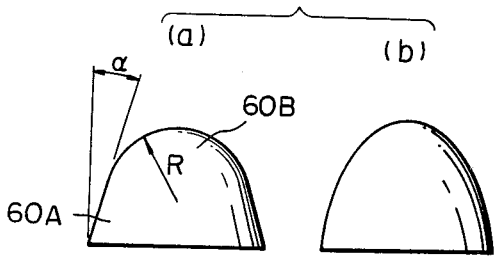
FIG. 5 shows two different shapes of the guide member according to the present invention.

As shown by (a) in FIG. 5, the guide member 60 may have a cone-shaped base portion 60A and a rounded tip portion 60B having a diameter of R. The taper angle $\alpha$ of the cone is suitably selected so that the desired curve $II_3$ shown in FIG. 3 can be obtained. As shown by (b), the guide member 60 may have a shape shown by FIG. 5(*b*).

Figure 6:
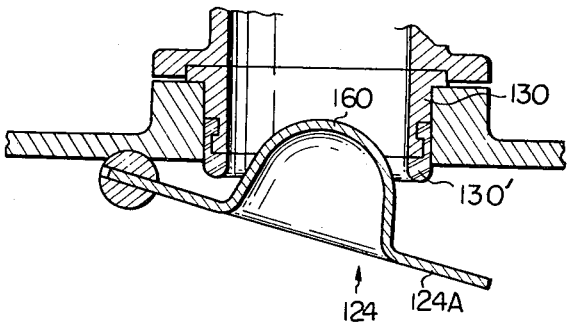
FIG. 6 illustrates another embodiment of the present invention.

In an embodiment shown in FIG. 6, a valve member 124 comprises a base portion 124A of a flat shape and a projected portion 160, both portions being made from one piece of material. An annular seal member 130' is mounted onto the valve seat 130.

Many modifications and changes can be made to the present invention by those skilled in this art without departing from the scope of the invention.

What is claimed is:

1. An exhaust gas recirculating system for a diesel engine having a gas exhaust passageway connected with an exhaust gas recirculating passageway, and an air intake passageway having an exhaust gas recirculating control valve to which said recirculating passageway connects; said valve forming a straight passageway having a rectangular cross section and flat sides of which one side has an exhaust gas inlet opening to which said recirculating passageway connects, the valve's said straight passageway being connected in series with said air intake passageway and having a rectangular valve plate provided with means for pivoting one edge portion of the plate parallel to and adjacent to said one side and on the upstream side of said inlet opening so that the valve plate swings downstream so as to cover the inlet opening while opening said straight passageway and vice versa, the edges of said valve plate each being parallel to the adjacent one of said flat sides of the valve's said straight passageway and said valve having means for swinging said valve plate; wherein the improvement comprises said valve plate on its side which covers said inlet opening having a projecting member which inserts in said inlet opening to a degree depending on the degree said valve plate swings downstream so to more or less cover the inlet opening, said guide member being contoured so as to maintain substantially constant the ratio of flow through said inlet opening and through said straight passageway on the downstream side of said valve plate as the latter swings through positions more or less covering said inlet opening.

2. A valve device according to claim 1, wherein said plate and said projecting members are connected to each other.

3. A valve device according to claim 1, wherein said plate and said projecting member are made from one piece of material.

4. A valve device according to claim 1, wherein said projecting member has an outer surface tapering toward said exhaust gas inlet opening.

5. A valve device according to claim 4, wherein said projecting member forms a truncated cone shape with a rounded tip end.

6. A valve device according to claim 4, wherein said projecting member forms a spindle shape.

* * * * *

UNITED STATES PATENT AND TRADEMARK OFFICE

CERTIFICATE OF CORRECTION

PATENT NO. : 4,237,837

DATED : December 9, 1980

INVENTOR(S) : Tadahide Toda, et al

It is certified that error appears in the above—identified patent and that said Letters Patent is hereby corrected as shown below:

Col. 6, line 13, change "members" to --member--.

Signed and Sealed this

*Twelfth* Day of *May 1981*

[SEAL]

*Attest:*

RENE D. TEGTMEYER

*Attesting Officer*

*Acting Commissioner of Patents and Trademarks*